United States Patent [19]

Brinton et al.

[11] Patent Number: 4,924,271

[45] Date of Patent: May 8, 1990

[54] OIL DISTRIBUTION SYSTEM FOR A HEAT AND PRESSURE FUSER

[75] Inventors: Catherine A. Brinton, Rochester; Adalbert A. Lux, Penfield, both of N.Y.

[73] Assignee: Xerox Corporation, Stamford, Conn.

[21] Appl. No.: 231,120

[22] Filed: Aug. 11, 1988

[51] Int. Cl.[5] ..... G03G 15/20; G03G 21/00

[52] U.S. Cl. ..... 355/284; 118/267; 222/422; 239/551

[58] Field of Search ..... 355/282, 284; 118/60, 118/260, 267, 268; 222/420, 422; 239/76, 551

[56] References Cited

U.S. PATENT DOCUMENTS

| | | | |
|---|---|---|---|
| 1,462,903 | 7/1923 | Finley | 239/551 |
| 3,912,165 | 10/1975 | Pira | 239/551 X |
| 3,964,431 | 6/1976 | Namiki | 118/60 |
| 3,970,222 | 7/1976 | Duffield | 222/420 X |
| 4,040,383 | 8/1977 | Vandervort | 118/260 X |
| 4,294,406 | 10/1981 | Pevnick | 222/422 X |
| 4,336,766 | 6/1982 | Maher et al. | 118/60 |
| 4,536,076 | 8/1985 | Bickerstaff et al. | 355/284 |

*Primary Examiner*—Fred L. Braun

[57] ABSTRACT

An oil distribution system for a heat and pressure fuser includes a metering assembly which gravity feeds oil along an inclined channel to a plurality of reservoirs. The metering assembly has a length which approximates the length of the fuser roll surface to be oiled. Oil is introduced into the inclined channel and fills each of the reservoirs. The reservoirs are fully enclosed save for an oil dispensing orifice located at the bottom of the reservoir. This orifice is small enough to control the rate of oil dispersed onto a primary wick located beneath the reservoir. The reservoirs are spaced in such a way that uniform dispensation of oil is provided. The primary wick receives the oil and feeds it to a fuser roll. A secondary wick helps to control the uniformity of the oil on the fuser roll.

5 Claims, 3 Drawing Sheets

OIL DISTRIBUTION SYSTEM FOR A HEAT AND PRESSURE FUSER

BACKGROUND OF THE INVENTION AND MATERIAL DISCLOSURE STATEMENT

The invention relates generally to xerographic copying apparatus, and more particularly, it relates to the heat and pressure fixing of particulate thermoplastic toner by direct contact with a heated fusing member.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto in one of various ways, for example, as by the use of heat and pressure.

In order to affix or fuse electroscopic toner material onto a support member by heat and pressure, it is necessary to elevate the temperature of the toner material to coalesce and become tacky while simultaneously applying pressure. This action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic as well as the electrographic recording arts, the use of thermal energy and pressure for fixing toner images onto a support member is old and well known.

The commonly utilized approach to heat and pressure fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the other image contacting the fuser roll thereby to affect heating of the toner images within the nip. By controlling the heat transferred to the toner, virtually no offset of the toner particles from the copy sheet to the fuser roll is experienced under normal conditions. This is because the heat applied to the surface of the roller is insufficient to raise the temperature of the surface of the roller above the "hot offset" temperature of the toner whereas the toner particles in the image areas of the toner liquify and cause a splitting action in the molten toner resulting in "hot offset". Splitting occurs when the cohesive forces holding the viscous toner mass together are less than the adhesive forces tending to offset it to a contacting surface such as a fuser roll.

Occasionally, however, toner particles will be offset to the fuser roll by an insufficient application of heat to the surface thereof (i.e. "cold" offsetting); by imperfections in the properties of the surface of the roll; or by the toner particles insufficiently adhering to the copy sheet by the electrostatic forces which normally hold them there. In such a case, toner particles may be transferred to the surface of the fuser roll with subsequent transfer to the backup roll during periods of time when no copy paper is in the nip.

Moreover, toner particles can be picked up by the fuser and/or backup roll during fusing of duplex copies or simply from the surroundings of the reproducing apparatus.

One arrangement for minimizing the foregoing problems, particularly that which is commonly referred to as "offsetting", has been to provide a fuser roll with an outer surface or covering of polytetrafluoroethylene or silicone rubber, the former being known by the tradename Teflon TM, to which a release agent such as silicone oil is applied, the thickness of the Teflon TM being on the order of several mils and the thickness of the oil being less that 1 micron. Silicone based (polydimethylsiloxane) oils, which possess a relatively low surface energy, have been found to be materials that are suitable for use in the heated fuser roll environment where Teflon TM constitutes the outer surface of the fuser roll. In practice, a thin layer of silicone oil is applied to the surface of the heated roll to form an interface between the roll surface and the toner images carried on the support material. Thus, a low surface energy layer is presented to the toner as it passes through the fuser nip and thereby prevents toner from offsetting to the fuser roll surface.

There are various mechanisms known in the prior art to supply silicone oil to the surface of a heated fuser roll. For small copy volume, a wicking material is impregnated with the oil and is placed in contact with the fuser roll surface. A typical system of this type is disclosed in U.S. Pat. No. 3,964,631 in which a supply roller impregnated with oil is maintained in contact with the fuser roll. Further details of wick construction are disclosed in Xerox Disclosure Journal, Vol. 4, March/April 1975, page 163.

A crucial problem to be solved with any oil dispensing machine is the regulation of the oil distribution so that it is evenly applied to the fuser roll surface. This problem has been addressed in several ways; the Xerox 1075 copier utilizes a metering pump to regulate oil application to a wick applicator. The Xerox 1065 copier utilizes a metering roll system of the type disclosed in the U.S. Pat. No. 3,964,431. These methods are satisfactory for many applications but there remain certain types of operating conditions requiring even more precise oil application mechanism. As one example, the Xerox 2510 large document copier is capable of copying original documents up to 36 inches long, requiring a fuser roll of similar dimensions. Surfaces of this length present exceptional difficulties in maintaining uniform oil application. Several prior art designs address this problem. In U.S. Pat. No. 4,336,766, an oil dispensing device consists of a hollow chamber which supports a first and second wick member, and which has a plurality of apertures for distributing oil at intervals along the length of the fuser roll. U.S. Pat. No. 4,536,076 utilizes a pump to distribute oil to a distribution gallery which communicates with a plurality of drop-forming chambers. The chambers, in turn, dispense oil in droplets onto a wick in contact with the fuser surface. These prior art devices provide acceptable oil distribution, but may still be improved on by further improving the oil application along relatively longer fuser roll lengths.

The present invention is therefore directed to an oil distribution system particularly adapted to maintain uniform oil distribution along a fuser roll surface. More particularly, the present invention is directed toward an apparatus for forming toner images on a copy substrate, said apparatus including a fuser roll, and a release oil distribution assembly, such oil assembly comprising:

a metering chamber including a metering channel having an oil flow surface at a downward inclination of some angle $\theta$ to the horizontal, a plurality of enclosed reservoirs located beneath, and in communication with said metering channel, each of said reservoirs having an orifice at the bottom thereof, and an oil application wick assembly extending along the length of said metering chamber and plurality of reservoirs, said wick assembly adapted to disperse oil by capillary action to the fuser roll surface.

DETAILED DESCRIPTION OF THE INVENTION

Figure 1:
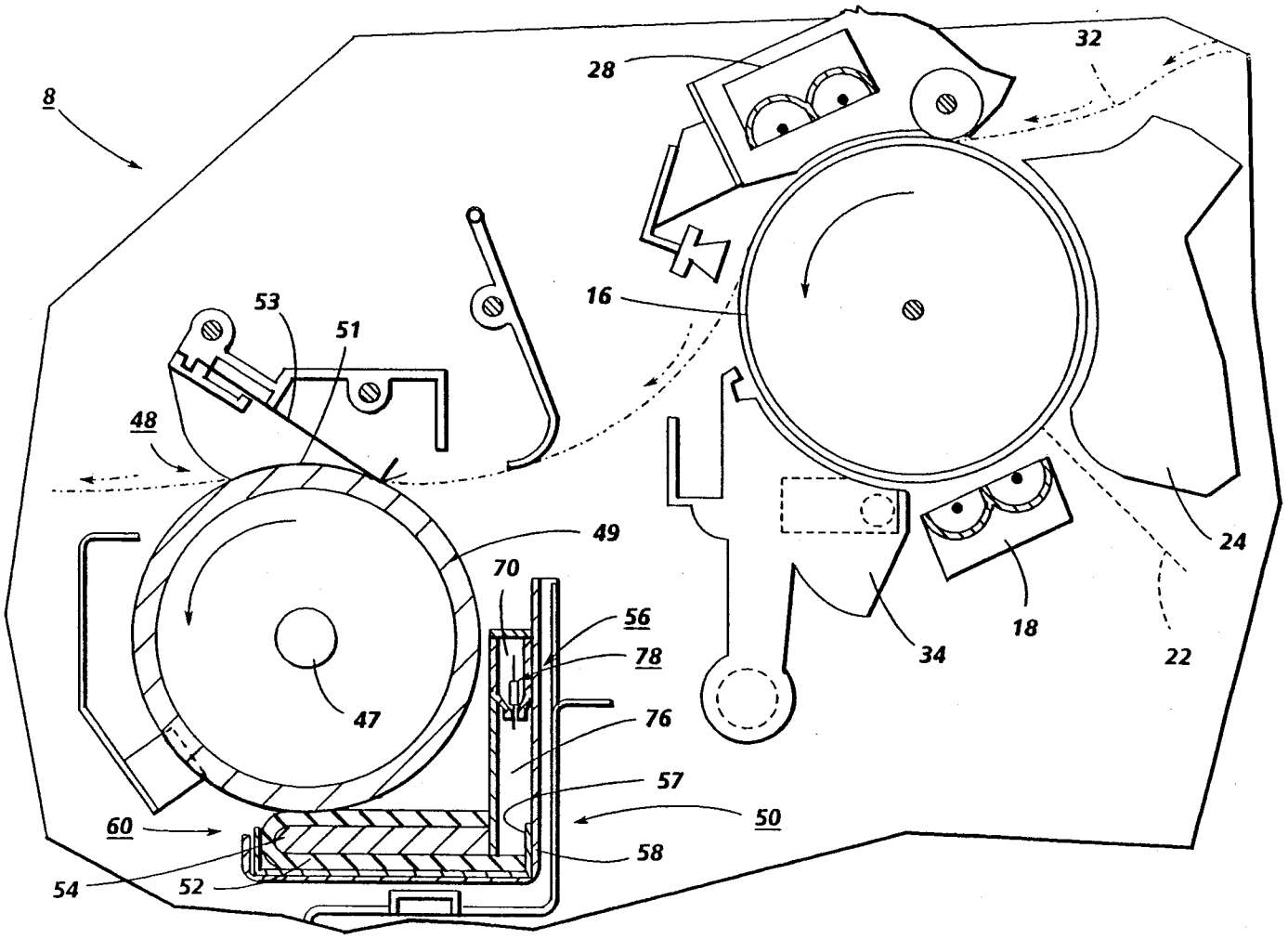
FIG. 1 is a side view of a reproduction machine having the fuser roll oil distribution mechanism of the present invention.

Referring to FIG. 1 of the drawings, there is shown a reproduction machine 8 incorporating the present invention. A portion of a xerographic machine 8 is shown with the various optical and xerographic stations. Briefly, as will be familiar to those skilled in the xerographic printing and copying arts, the xerographic components of the machine include a charge retentive recording member shown here in the form of a rotatable photoreceptor 16. In the exemplary arrangement shown, photoreceptor 16 comprises a drum having a photoconductive surface. Other photoreceptor types such as belt, web, etc. may instead be employed.

Operatively disposed about the periphery of photoreceptor 16 are a charging station 18 for placing a uniform charge on the photoconductive surface of photoreceptor 16; exposure station 22 where the previously charged photoconductive surface is exposed. The surface is exposed to form a latent image either by light rays reflected from a scanned document and projected by a lens or by a raster input scanner (RIS) whose output is a modulated light beam which "writes" upon the drum surface to form a latent image according to the input information regulating the RIS. Continuing with the system description, the latent electrostatic image created on the photoconductive surface is developed by toner at development station 24. The transfer portion of the combined transfer and detack station 28 provides for sequentially transferring the developed image to a suitable copy substrate material such as a copy sheet 32 brought forward in timed relation with the developed image on photoconductive surface. The detack portion lessens the forces of attraction between the copy substrate and the photoreceptor surface.

Cleaning station 34 removes leftover developer from the photoconductive surface, and neutralizes residual charges thereon.

Copy sheet 32 is brought forward to transfer station 28 by a gripper bar system (not shown). Following transfer, the sheet 32 is carried forward to a fusing station 48 where the toner image is contacted by fusing roll 49 which forms one member of the heat and pressure fuser. Fusing roll 49 is heated by a suitable heat such as quartz lamp 47 disposed within the interior of roll 49. After fusing, the copy sheet 32 is discharged from the machine onto an appropriately placed output tray.

The fuser roll 49 comprises a thermally conductive tube having a thin (i.e. approximately 0.005 inch (0.01 centimeters)) coating of silicone rubber on the exterior surface thereof which contacts the toner images on the copy substrate to thereby affix them to the substrate. An oil distribution mechanism 50, described in further detail below, applies a thin uniform layer of silicone oil to the bottom surface of the fuser roll for the prevention of toner offset thereto as well as reducing the torque required to affect rotation of the fuser roll. In sheet-fed applications it also acts as a release agent for the lead edge of the paper. In one operative embodiment of the fuser roll, its diameter was 3.3 inches and had a length of 40 inches. This embodiment is typically used to fuse images on copy substrates that are 3 feet (0.91 meters) wide by 4 feet (1.22 meters) in length.

The fuser apparatus 48 in the preferred embodiment also comprises a nonrotating, elongated pressure member such as a web or sling 51 to maintain the copy paper in contact with the fuser roll through the fusing area. Web 51 is biased against the fuser roll surface by a blade 53. Details of the web positioning and bracing against the fuser roll is described in U.S. Pat. No. 4,629,471, which contents are hereby incorporated by reference.

Figure 2:
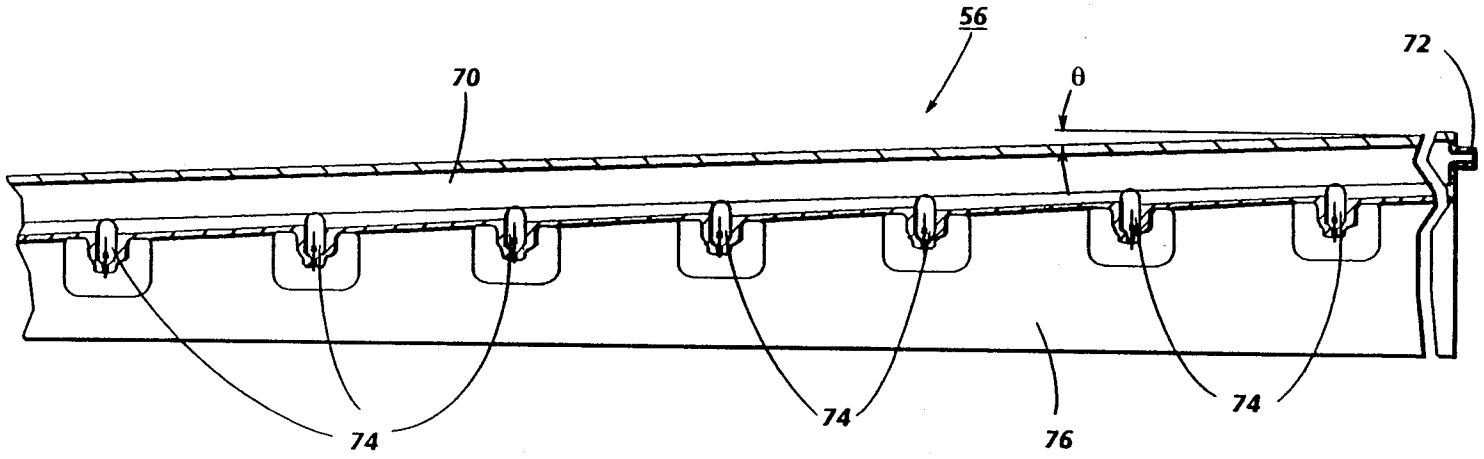
FIG. 2 shows a front view, in detail, of the metering bar.
Figure 3:
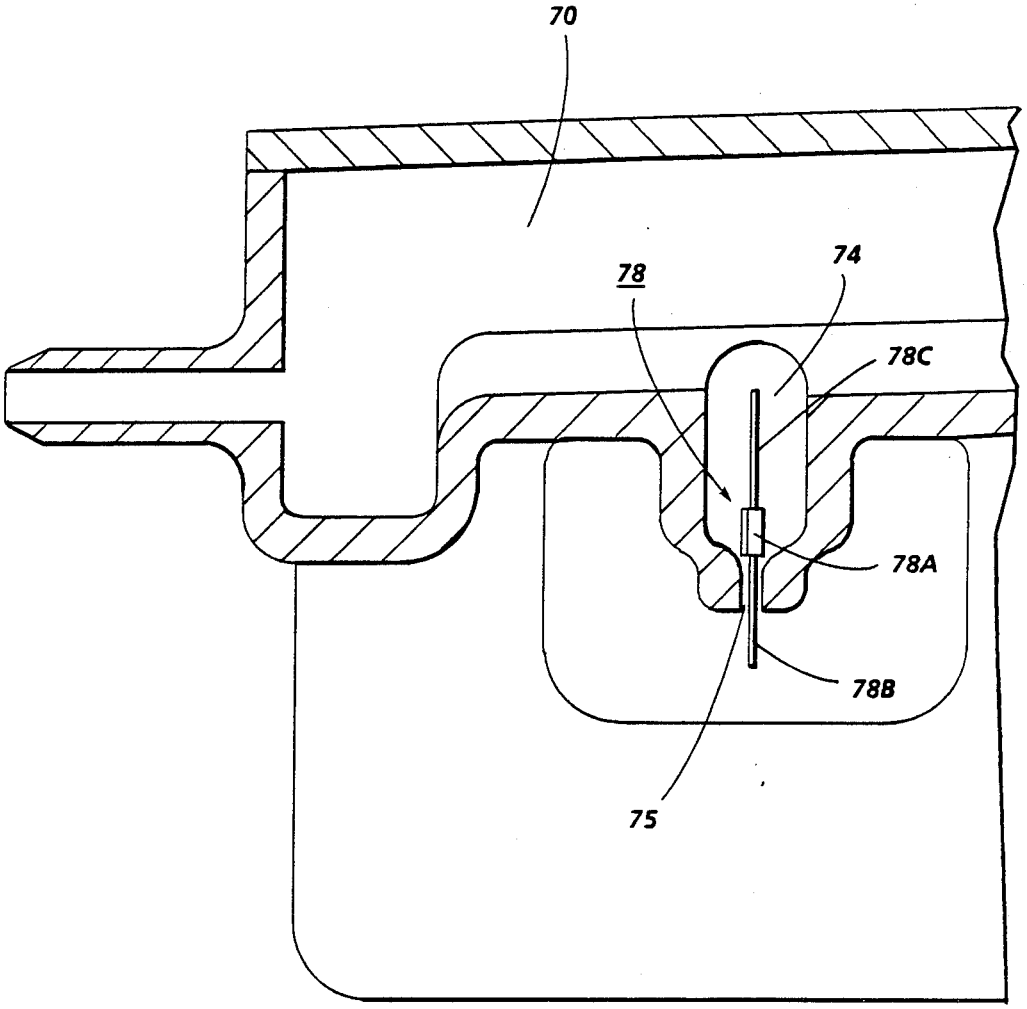
FIG. 3 is an enlarged view showing, in detail, one of the plurality of oil dispensing reservoirs contained within the metering bar of FIG. 2.

Turning now to fuller consideration of oil distribution assembly 50, FIG. 2 offers a front view of the metering bar; and FIG. 3 an enlarged view of one of the mini-reservoirs contained within the metering bar. Referring to FIGS. 1, 2 and 3, assembly 60 comprises a first primary wick 52, a secondary wick 54 in contact along the length of fuser roll 49 at the six o'clock position; and metering bar 56. Wick 52, and bar 56 are inserted into a tray 57 located on a bracket 58 which, in turn, is secured to the machine frame. Metering bar 56, shown in front view in FIG. 2, consists of a metering channel 70 which is inclined to the horizontal by an angle $\theta$. Channel 70 has an aperture 72 at the "high" end through which the oil is periodically pumped. Channel 70 is in communication with a plurality of reservoirs 74 distributed along the length of, and beneath, the channel. Each circular reservoir has a circular aperture 75 centrally located at the bottom. In each aperture is seated a pin 78 having a central portion 78A of larger diameter than the extremities 78B, 78C. Portion 78B is seated within aperture 75. The diameter difference between aperture 75 and pin portion 78B controls the drip rate. In a preferred embodiment, aperture 75 is 1 millimeter and pin portion 78B is 0.89 millimeter, but depending on the particular system and the viscosity of the oil, a range of 0.05 millimeter to 2 millimeters can be used.

Continuing with the description, the metering bar also includes a wick reservoir channel 76 at the bottom of which is placed the primary wick 52.

In operation, oil is periodically pumped into the high end of channel 70 at aperture 72. Because of the channel inclination, gravity acts on the oil causing it to flow down the channel toward the lower end. As the oil encounters each of the reservoirs 74, it fills each reservoir. An inclination of $\theta=2°$ has been found to provide satisfactory distribution for the oil used.

The apertures 75, or its equivalent for the pin embodiment, is small enough so that oil seeps out slowly dispensing a drop of oil in a relatively long (3 to 5 minutes) time interval. Because of this slow drip rate, oil will flow along the channel and fill all of the reservoirs before the first reservoir at the high end begins to dispense. Wick 52 is wrapped around wick 54 with the bottom portion of wick 52 laying on tray 57. Oil drips from orifice 75 onto wick 52. Through capillary action the oil defuses and the wick feeds the oil to the surface of the fuser roll 49. Wick 54 acts as a reservoir and helps to control the uniformity of the amount of oil that is deposited on roll 49. The reservoirs 74 are spaced close enough (24 over a 36 inch length) that by the time the oil migrates to the top surface of wick 54 the uniformity of the oil concentration is sufficient for application.

The total oil availability is controlled by energizing the pump for a predetermined number of strokes after a given amount of media is processed. For example, if an equivalent of 1 $\mu$l of oil per 8.5 inch$\times$11 inch sheet of media is desired, this can be obtained with 50 pump strokes for every 500 feet of media run for a given volume of the reservoirs. To ensure that the reservoirs all fill, the pump always delivers an excess of oil. The excess oil can be collected into an overflow bottle or fed back to the main pump reservoir.

While the invention has been described with reference to the structure disclosed, it is not confined to the details set forth. For example, the pin 78 has been utilized because it is more convenient to bore holes one millimeter in diameter. However, an alternative embodiment can dispense with the pin, and utilize an aperture alone having a diameter designed to permit the desired dispensing rate. While an aperture size from 0.1 millimeter to 1 millimeter is possible, depending on the size of the system and the oil viscosity, an optimum size of 0.25 millimeter has been determined for the fuser system described. This size is larger than the 0.11 millimeter difference in the pin and seating orifice described; the smaller diameter is made possible by the difference in surface tension between the pin and the aperture well.

The invention is therefore intended to cover such modifications or changes as may come within the scope of the following claims:

What is claimed is:

1. Apparatus for forming toner images on a copy substrate, said apparatus including a fuser roll, and a release oil distribution assembly, such oil assembly comprising:

a metering chamber including a metering channel having an oil flow surface aligned in a plane at an angle $\theta$ to the horizontal, a plurality of enclosed reservoirs located beneath, and in communication with said metering channel, each of said reservoirs having an orifice at the bottom thereof, said reservoirs located in a plane parallel to said oil flow surface plane whereby said reservoirs are progressively filled, under the influence of gravity, from the end of said channel below the horizontal and progressing towards the reservoris located at the channel end above the horizontal, and an oil application wick assembly wick extending along the length of said metering chamber and plurality of reservoirs, said wick assembly adapted to dispense oil by capillary action to the fuser roll surface.

2. The apparatus of claim 1 wherein angle $\theta$ is approximately 2°.

3. The apparatus of claim 1 wherein said reservoir orifice has an aperture with a diameter of approximately 0.01 millimeter to 1millimeter.

4. The apparatus of claim 1 further including a pin seated within said orifice.

5. The apparatus of claim 4 wherein said pin has a central portion wider in diameter than extremity portions, and wherein the difference between the extremity portion seated within said orifice and the diameter of said orifice ranges from 0.5 millimeter to 2 millimeters.

* * * * *